United States Patent [19]

Hudson

[11] Patent Number: 4,982,705

[45] Date of Patent: Jan. 8, 1991

[54] CAM PULLEY AND CYLINDER HEAD ARRANGEMENT FOR AN OVERHEAD CAM ENGINE

[75] Inventor: Eric B. Hudson, Hilbert, Wis.

[73] Assignee: Tecumseh Products Company, Tecumseh, Mich.

[21] Appl. No.: 483,063

[22] Filed: Feb. 21, 1990

[51] Int. Cl.[5] ..... F01P 7/04

[52] U.S. Cl. ..... 123/41.65; 123/41.7

[58] Field of Search ..... 123/41.49, 41.62, 41.63, 123/41.65, 41.69, 41.7, 90.17, 90.27, 90.31

[56] References Cited

U.S. PATENT DOCUMENTS

| | | | |
|---|---|---|---|
| 1,270,124 | 6/1918 | Davidson | 123/41.66 |
| 1,271,354 | 7/1918 | Nus | 123/90.27 |
| 1,357,135 | 10/1920 | Anderson | 123/41.65 |
| 1,464,357 | 8/1923 | Fox | 123/41.62 |
| 1,512,546 | 10/1924 | Kimble | 474/93 |
| 1,673,191 | 6/1928 | Gille | 123/41.65 |
| 2,270,990 | 1/1942 | Bachle | 123/171 |
| 2,410,411 | 11/1946 | Gregory | 123/90 |
| 2,426,438 | 8/1947 | DePew | 123/90 |
| 3,079,902 | 3/1963 | Ulbrich | 123/41.69 |
| 3,166,053 | 1/1965 | Fischer et al. | 123/41.69 |
| 3,598,092 | 8/1971 | Honda | 123/41.28 |
| 3,669,082 | 6/1972 | Hatz | 123/41.65 |
| 4,216,746 | 8/1980 | Freyn | 123/41.69 |
| 4,391,231 | 7/1983 | TateBe et al. | 123/41.69 |
| 4,493,677 | 1/1985 | Ikenoya | 474/93 |
| 4,525,993 | 7/1985 | Dumoulin et al. | 57/58.52 |
| 4,561,386 | 12/1985 | Tamba et al. | 123/41.7 |
| 4,633,824 | 1/1987 | Umeda et al. | 123/41.65 |
| 4,635,592 | 1/1987 | Weichsler | 123/90.18 |

FOREIGN PATENT DOCUMENTS

| | | | |
|---|---|---|---|
| 55-37507 | 3/1980 | Japan . | |
| 2066361 | 7/1981 | United Kingdom | 123/90.17 |

*Primary Examiner*—Noah P. Kamen

*Attorney, Agent, or Firm*—Jeffers, Hoffman & Niewyk

[57] ABSTRACT

An air-cooled internal combustion engine includes a crankcase, a crankshaft disposed within the crankcase and extending externally thereof, and a cylinder extending from the crankcase and having a piston mounted for reciprocation therein and connected to the crankshaft. A cylinder head is connected to the cylinder and includes an overhead camshaft disposed therein, with the camshaft extending externally of the cylinder head. A drive pulley is mounted to the crankshaft externally of the crankcase, and a cam pulley is mounted to the camshaft externally of the cylinder head. A drive belt positively engages the drive pulley and the cam pulley for transmitting rotary motion therebetween. The cam pulley includes integral fan blades for directing air axially toward the cylinder head upon rotation of the cam pulley. The cylinder head includes an intake valve, an exhaust valve, and an air passageway extending therethrough substantially parallel to the camshaft. The air passage is located between the intake and exhaust valves and between the camshaft and the cylinder.

13 Claims, 2 Drawing Sheets

CAM PULLEY AND CYLINDER HEAD ARRANGEMENT FOR AN OVERHEAD CAM ENGINE

BACKGROUND OF THE INVENTION

The present invention relates generally to overhead cam air-cooled internal combustion engines, and more particularly to such engines wherein the camshaft is driven by an external timing belt and cam pulley.

Air-cooled internal combustion engines often employ a combination fan/flywheel mounted directly on the crankshaft externally of the crankcase to supply a flow of cooling air over the engine. Since the flywheel is located near the crankcase rather than near the cylinder and cylinder head, which are the portions of the engine most in need of cooling, a blower housing or other ducting is often used to direct the flow of air from the fan/flywheel toward and over the cylinder and cylinder head. This scheme works well in L-head or overhead valve type engines where the valve actuating mechanism is enclosed within the engine castings, since the exteriors of the cylinder and the cylinder head are unobstructed and covered with cooling fins.

In the case of toothed belt driven overhead cam type engines, however, a cam pulley is normally located on an extension of the camshaft externally of the cylinder head, and tends to obstruct the flow of air over the cylinder and cylinder head. This problem cannot be alleviated to a sufficient degree by reducing the diameter of the cam pulley, since four-cycle internal combustion engines require a 2:1 speed reduction of the camshaft relative to the crankshaft, which necessitates the cam pulley being twice as large as the drive pulley.

It has been found that even non-solid cam pulleys having a spoked support structure cause significant obstruction of air flow. This is believed to be caused by such pulleys acting as centrifugal blowers wherein the spokes tend to cause air to be thrown radially outwardly rather than passing through the open areas of the pulley.

It would be desirable to provide an overhead cam type air-cooled internal combustion engine with external drive of the camshaft while avoiding obstruction of cooling air flow over the cylinder and cylinder head.

SUMMARY OF THE INVENTION

The present invention, in accordance with one embodiment thereof, involves an air-cooled internal combustion engine of the overhead cam type wherein the camshaft is driven by an external cam pulley connected to a drive pulley by a positive engagement timing belt or chain. The cam pulley is provided with integral fan blades for causing air to flow through the cam pulley upon rotation of the cam pulley during engine operation. The blades are oriented to cause air to flow toward and over the cylinder and cylinder head, thereby overcoming the air flow blocking effect that the cam pulley would otherwise have.

In accordance with a further aspect of the present invention exemplified in a preferred embodiment, the cylinder head includes an air passageway therethrough disposed substantially parallel to the camshaft and located between the intake and exhaust valves and between the camshaft and the cylinder. The air passageway increases the cooling surface area of the cylinder head, especially in the immediate proximity of the valves and combustion chamber. The passage of cooling air to the side of the cylinder head opposite the cam pulley is also facilitated.

Another aspect of the present invention involves the combined cooling effect of a combination fan/flywheel mounted on the crankshaft, a cam pulley configured as a fan, and a blower housing overlying both such that air is drawn in axially by the fan/flywheel, directed longitudinally of the cylinder by the blower housing, and then drawn axially by the fan/cam-pulley and directed particularly over the cylinder head.

In accordance with a preferred embodiment, the present invention includes an air-cooled internal combustion engine having a crankcase, a crankshaft disposed within the crankcase and extending externally thereof, and a cylinder extending from the crankcase and having a piston mounted for reciprocation therein and connected to the crankshaft. A cylinder head is connected to the cylinder and includes an overhead camshaft disposed therein. The camshaft extends externally of the cylinder head. A drive pulley is mounted to the crankshaft externally of the crankcase, and a cam pulley is mounted to the camshaft externally of the cylinder head. The cam pulley includes a plurality of fan blades for directing air axially toward the cylinder head upon rotation of the cam pulley. Drive means positively engages the drive pulley and the cam pulley for transmitting rotary motion therebetween.

In accordance with an alternative embodiment, the present invention further includes a cylinder head having an intake valve, an exhaust valve, and an air passageway extending therethrough substantially parallel to the camshaft, the air passage being located between the intake and exhaust valves and between the camshaft and the cylinder.

It is an object of the present invention to provide an air-cooled internal combustion engine of the overhead cam type and having an externally driven cam pulley which does not block cooling air flow over the cylinder head.

Further objects and advantages of the present invention will be apparent from the following description of a preferred embodiment.

DESCRIPTION OF THE PREFERRED EMBODIMENTS

Figure 1:
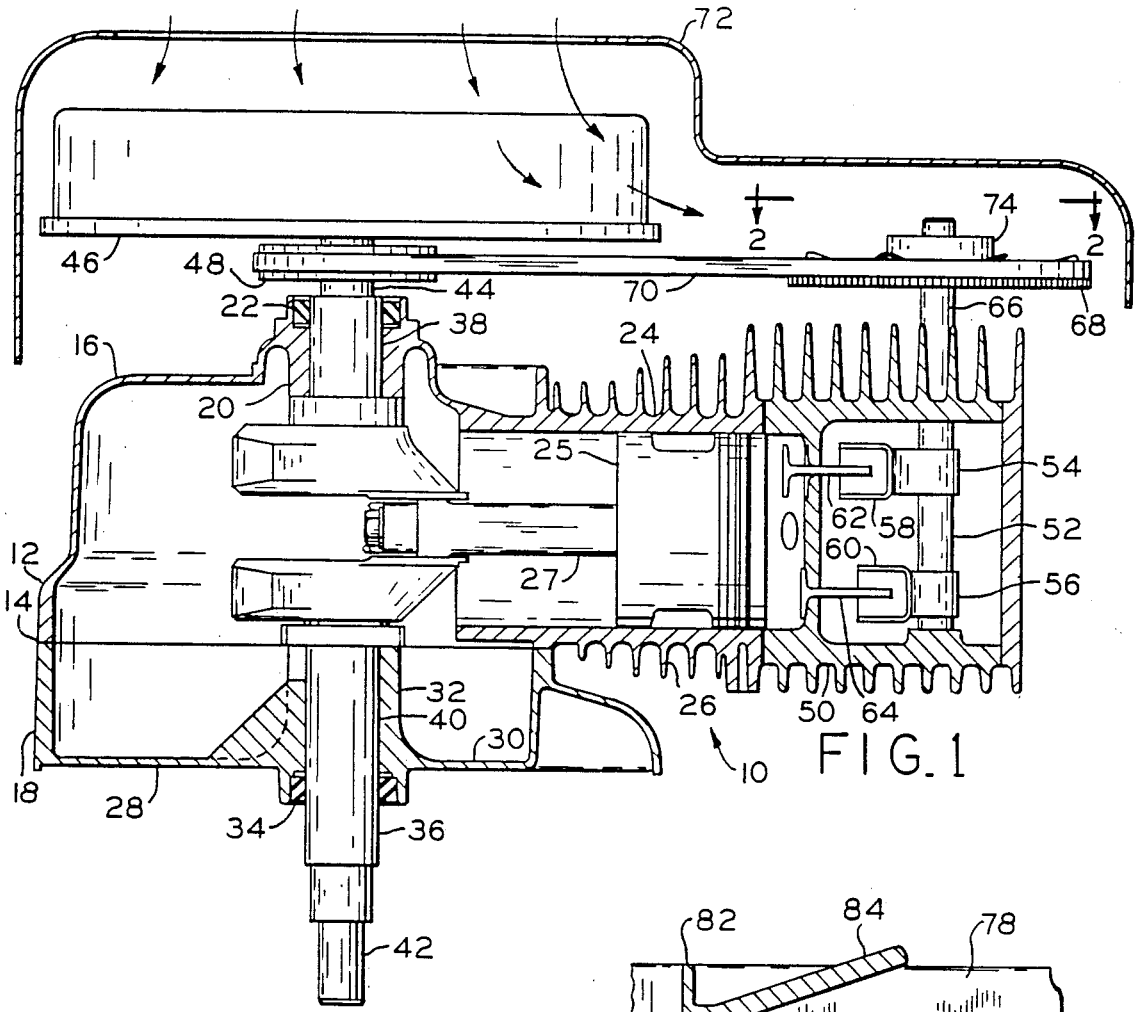
FIG. 1 is a vertical section view of an internal combustion engine in accordance with the present invention, taken in the plane defined by the axis of the crankshaft and the axis of the cylinder.

Referring in particular to FIG. 1, there is illustrated a vertical crankshaft type internal combustion engine 10 configured in accordance with the present invention. Engine 10 includes a crankcase 12 which is divided along separation line 14 into upper crankcase housing 16 and lower crankcase housing 18. Upper crankcase housing 16 includes upper crankshaft bearing journal 20 and upper crankshaft seal 22. Extending horizontally from upper crankcase housing is cylinder 24, which includes vertically oriented circumscribing cooling fins 26 cast integrally therewith. Disposed for horizontal reciprocation within cylinder 24 is piston 25, which is linked to crankshaft 36 via connecting rod 27. Lower crankcase housing 18 provides a mounting base 28 for engine 10 and also provides a lubrication oil sump 30. Lower crankcase housing 18 includes lower crankcase bearing journal 32 and lower crankshaft seal 34.

Vertically disposed within crankcase 12 is crankshaft 36 having upper shaft portion 38 situated within upper crankshaft journal 20 and having lower shaft portion 40 situated within lower crankshaft journal 32. Lower extension 42 of lower shaft portion 40 provides a drive shaft stub for power take off from engine 10 to be connected to a lawnmower blade or other element. Upper extension 44 of upper shaft portion 38 provides a drive shaft stub for driving combination fan/flywheel 46, which is attached thereto for rotation therewith. Also attached to extension 44 for rotation therewith is drive pulley 48 which will be explained further below.

With continued reference to FIG. 1, cylinder head 50 is attached conventionally via bolts (not shown) to the top (with respect to the direction of piston movement) of cylinder 24. Overhead camshaft 52 is journalled for rotation within cylinder head 50 and is oriented vertically and parallel to crankshaft 36. Integral cam lobes 54 and 56 on camshaft 52 engage valve operators 58 and 60 which in turn cause reciprocation of intake and exhaust valves 62 and 64. Camshaft 52 includes extension 66 which extends upwardly and exteriorly of cylinder head 50. Mounted to extension 66 for rotation therewith is cam pulley 68 which is mounted in the same horizontal plane as drive pulley 48. A flexible timing belt 70 having notches on the inside surface thereof oriented perpendicularly to the direction of belt travel connects drive pulley 48 to cam pulley 68 in driving relationship. Drive pulley 48 and cam pulley 68 are similarly notched to ensure positive registration of timing belt 70 with each pulley, thereby maintaining over time the desired angular relationship between crankshaft 36 and camshaft 66. Cam pulley 68 has a diameter which is twice that of drive pulley 48, which results in camshaft 52 rotating at one-half the rate of rotation of crankshaft 36. This 2:1 speed relationship is necessitated by the four-cycle nature of engine 10.

Cooling of engine 10 is accomplished by the forced flow of air thereover, provided primarily by combination fan/flywheel 46, which is of conventional design. Fan/flywheel 46 operates predominantly as a centrifugal type blower, wherein air is drawn in axially toward crankshaft 36 and expelled radially. Blower cover 72, which overlies fan/flywheel 46, cylinder 24 and cylinder head 50, directs the radial air flow downwardly and over cylinder 24 and cylinder head 50.

Because of the relatively large diameter of cam pulley 68, necessitated by the required 2:1 speed reduction from drive pulley 48, air flow over cylinder head 50 would be largely blocked by cam pulley 68 if it were of conventional design. A solid cam pulley would totally prevent air flow therethrough, resulting in a substantial reduction in the cooling efficacy of fan/flywheel 46. It has been found that a conventional sprocketed or spoked cam pulley blocks the flow of air over cylinder head 50 nearly as greatly as a solid pulley. This is believed to be the result of such a pulley acting essentially like a centrifugal blower, causing axial air flow toward the camshaft generated by fan/flywheel 46 to be redirected around the cam pulley instead of proceeding through it.

Figure 3:
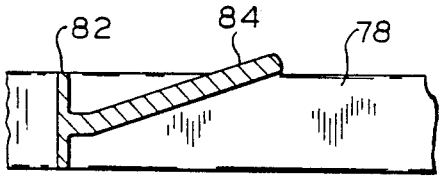
FIG. 3 is a partial section view of the cam pulley of FIG. 2, taken along line 3—3 of FIG. 2 and viewed in the direction of the arrows.
Figure 2:
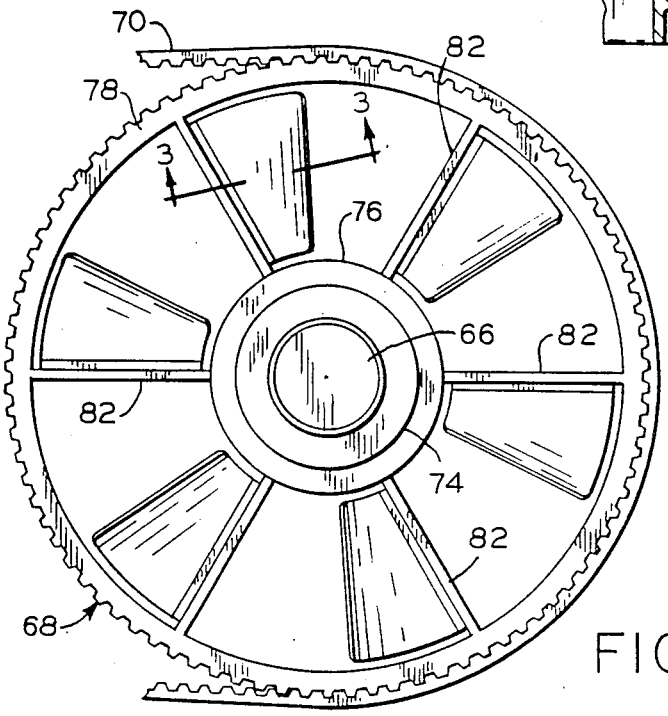
FIG. 2 is top view of the cam pulley of the engine of FIG. 1, taken along line 2—2 of FIG. 1 and viewed in the direction of the arrows.

The present invention permits the use of an external cam pulley driven by an external drive pulley on the crankshaft without impeding air cooling of the cylinder and cylinder head over which the cam pulley lies. This is accomplished by configuring the cam pulley as shown in FIGS. 2 and 3. Cam pulley 68 includes a hub 74 which circumscribes and mounts on extension 66 of camshaft 52. Hub 74 is secured to shaft 66 by conventional keying or splining to ensure that cam pulley 68 does not slip with respect to camshaft 52. An integral annular inner ring portion 76 is attached to hub 74 in a plane perpendicular to camshaft extension 66, and an integral annular outer ring portion 78 defining the outer diameter of cam pulley 68 is disposed in the same plane as inner ring 76. Connecting inner ring 76 and outer ring 78 in their common plane is a plurality of interspersed radial spokes 82. Fan blades 84 are inclined with respect to the plane of pulley 68 in a direction perpendicular to the radial spoke 82 from which fan blades 84 extend. The fan blades are so inclined that clockwise rotation of cam pulley 68 (as viewed from above) results in cam pulley 68 acting as a fan to accelerate air axially toward cylinder head 50, thereby overcoming the air blocking effect of the cam pulley and in fact positively contributing to the flow of air over cylinder head 50.

Portions 76, 82, 84 and 78 of pulley 68 may be integral and may be made of cast aluminum, molded plastic or any other suitable material. A preferred material for pulley 68 is nylon cast around a metal hub.

Figure 4:
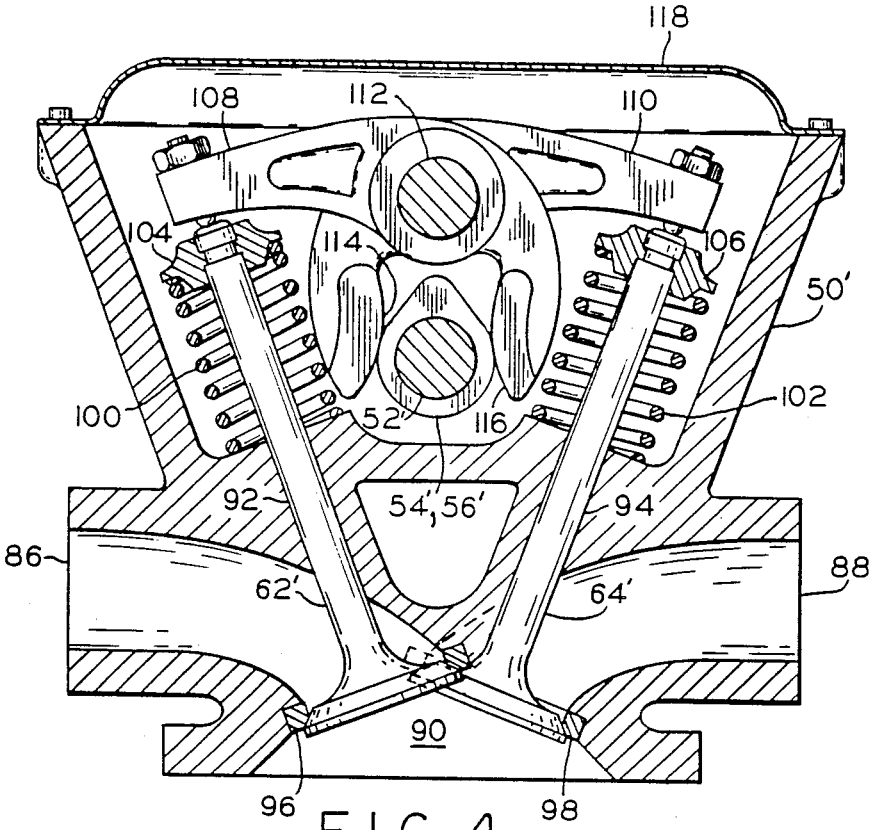
FIG. 4 is a horizontal section view of an alternative embodiment of a cylinder head useful in combination with the engine of FIG. 1.
Figure 5:
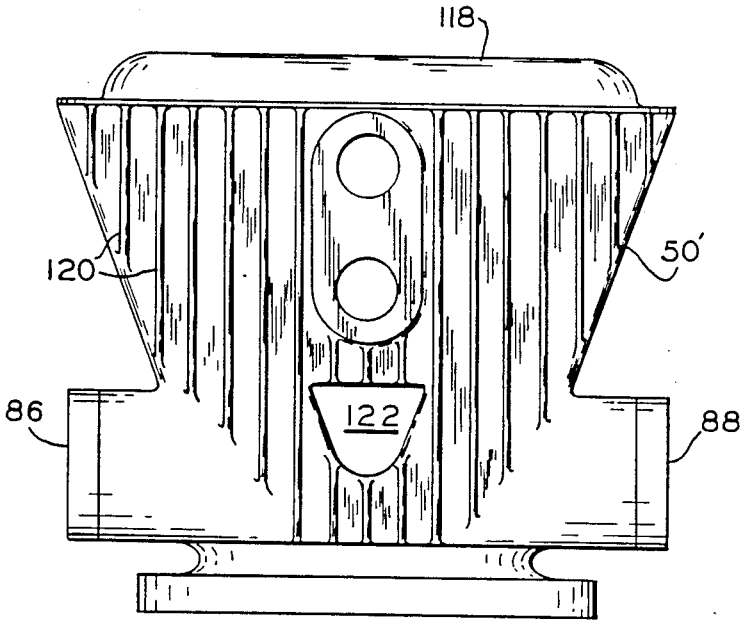
FIG. 5 is a top view of the alternative cylinder head of FIG. 4.

Referring in particular to FIGS. 4 and 5, there is illustrated an alternative embodiment of a cylinder head which is particularly suited for use in combination with the cam pulley arrangement described above. To facilitate orientation of the embodiment of FIGS. 4 and 5 to the embodiment of FIG. 1, elements which are alike in form or function are indicated by primed like reference numerals. Cylinder head 50' includes intake port 86 and exhaust port 88 located opposite one another on either side of cylinder head 50'. The flow of gases into and out of the combustion chamber is predominantly in the horizontal direction, and perpendicular to the axis of the camshaft 52'. Intake valve 62' and exhaust valve 64' are offset from one another in the axial direction of camshaft 52', and are inclined toward one another in the horizontal plane in the direction toward combustion chamber 90. Valves 62' and 64' reciprocate in valve guide bores 92 and 94, respectively, and are biased toward their respective valve seats 96 and 98 by valve springs 100 and 102 which bear with their bottom ends on cylinder head 50' and with their top ends on valve spring retainers 104 and 106, which are connected to the upper ends of the valve stems of valves 62' and 64'. A pair of rocker arms 108 and 110 are pivotally mounted on a rocker shaft 112 disposed in cylinder head 50' parallel to camshaft 52'. Cam follower surfaces 114 and 116 of rocker arms 108 and 110 engage the respective intake and exhaust cam lobes 54' and 56'. A removable cover 118 encloses the top end of cylinder head 50'.

Referring to FIGS. 4 and 5, it can be seen that cylinder head 50' is constructed with vertically oriented cooling fins 120 cast integrally therewith, and with a through opening 122 which provides a generally vertical passageway parallel to the axis of the camshaft for the passage of air through the cylinder head. Opening 122 is situated between the intake and exhaust valves 92 and 94, and below the camshaft 52', and serves to increase the total surface area of cylinder head 52' as well as to provide an additional path for cooling air to reach the bottom side of cylinder head 52'. In addition, opening 122 permits air to flow immediately adjacent the top of combustion chamber 90 and next to the valve heads.

What is claimed is:

1. In an air-cooled internal combustion engine including a crankcase, a crankshaft disposed within said crankcase and extending externally of said crankcase, a cylinder extending from said crankcase and having a piston mounted for reciprocation therein and connected to said crankshaft, a cylinder head connected to said cylinder and including an overhead camshaft disposed therein, the camshaft extending externally of said cylinder head, a drive pulley mounted to said crankshaft externally of said crankcase, a cam pulley mounted to said camshaft externally of said cylinder head, drive means positively engaging said drive pulley and said cam pulley for transmitting rotary motion therebetween, and blower means driven by said crankshaft for drawing air in and blowing the air over said cylinder head, the improvement in combination therewith comprising:

said cam pulley including means for directing air axially toward said cylinder head upon rotation of said cam pulley.

2. The internal combustion engine of claim 1, in which said means for directing air includes a plurality of fan blades.

3. The internal combustion engine of claim 2, in which said cam pulley includes a hub, said means for directing air comprises a plurality of fan blades attached to said hub and extending at an acute angle with respect to the plane of rotation of said cam pulley.

4. The internal combustion engine of claim 3, in which said drive pulley and said cam pulley include a notched outer peripheral surface and said drive means including a flexible belt having a notched inner surface corresponding to and engaging the notches of said drive and cam pulleys, whereby a cyclical angular relationship is maintained between said crankshaft and said camshaft.

5. The internal combustion engine of claim 4, in which said cam pulley has a diameter twice that of said drive pulley.

6. The internal combustion engine of claim 2, in which said cam pulley has a diameter twice that of said drive pulley.

7. The internal combustion engine of claim 2, in which said cylinder head includes an intake valve, an exhaust valve, and an air passageway extending through said head substantially parallel to said camshaft, said air passage being located between said intake and exhaust valves and between said camshaft and said cylinder.

8. The internal combustion engine of claim 7, in which said cylinder head includes an intake port and an exhaust port located on opposite sides of the cylinder head.

9. In an air-cooled internal combustion engine including a crankcase, a crankshaft disposed within said crankcase and extending externally of said crankcase, a cylinder extending from said crankcase and having a piston mounted for reciprocation therein and connected to said crankshaft, a cylinder head connected to said cylinder and including an overhead camshaft disposed therein, the camshaft extending externally of said cylinder head, a drive pulley mounted to said crankshaft externally of said crankcase, a cam pulley mounted to said camshaft externally of said cylinder head, drive means positively engaging said drive pulley and said cam pulley for transmitting rotary motion therebetween, a combination fan/flywheel mounted on said crankshaft externally of said crankcase and configured as a centrifugal blower for drawing air in axially of said crankshaft and expelling said air substantially radially, and a blower housing overlying said fan/flywheel and said cam pulley and configured for redirecting said radially expelled air axially of said camshaft over said cylinder head, the improvement in combination therewith comprising:

said cam pulley including means for directing air axially toward said cylinder head upon rotation of said cam pulley.

10. The internal combustion engine of claim 9, in which said means for directing air includes a plurality of fan blades.

11. An air-cooled internal combustion engine comprising:

a crankcase;

a crankshaft disposed within said crankcase and extending externally thereof;

a cylinder in said crankcase and having a piston mounted for reciprocation therein and connected to said crankshaft;

a cylinder head connected to said cylinder and including an overhead camshaft disposed therein, the camshaft extending externally of said cylinder head;

blower means for drawing air in axially of said crankshaft and expelling the air substantially radially and over said cylinder head;

a drive pulley mounted to said crankshaft externally of said crankcase;

a cam pulley mounted to said camshaft externally of said cylinder head, said cam pulley including a plurality of fan blades for directing air axially toward said cylinder head upon rotation of said cam pulley; and drive means positively engaging said drive pulley and said cam pulley for transmitting rotary motion therebetween.

12. An air-cooled internal combustion engine comprising:

a crankcase;

a crankshaft disposed within said crankcase and extending externally thereof;

a cylinder in said crankcase and having a piston mounted for reciprocation therein and connected to said crankshaft;

a cylinder head connected to said cylinder and including an overhead camshaft disposed therein, the camshaft extending externally of said cylinder head;

a drive pulley mounted to said crankshaft externally of said crankcase;

a cam pulley mounted to said camshaft externally of said cylinder head, said cam pulley including a plurality of fan blades for directing air axially toward said cylinder head upon rotation of said cam pulley; and drive means positively engaging said drive pulley and said cam pulley for transmitting rotary motion therebetween; and a combination fan/flywheel mounted on said crankshaft externally of said crankcase and configured as a centrifugal blower for drawing air in axially of said crankshaft and expelling said air substantially radially, and a blower housing overlying said fan/flywheel and said cam pulley and configured for redirecting said radially expelled air axially of said camshaft over said cylinder head.

13. The internal combustion engine of claim 12, in which said cylinder head includes an intake valve, an exhaust valve, and an air passageway extending through said head substantially parallel to said camshaft, said air passage being located between said intake and exhaust valves and between said camshaft and said cylinder.

* * * * *